United States Patent [19]

Cousin et al.

[11] Patent Number: 4,518,182

[45] Date of Patent: May 21, 1985

[54] ELECTRIC SAFETY LOCK MORE SPECIALLY FOR MOTOR VEHICLE DOORS

[75] Inventors: Maurice Cousin, Flers; Yves Pipon; Georges Droulon, both of St.-Georges-des-Groseillers; Jean Lebrun, La Lande/Patry Flers, all of France

[73] Assignee: A & M Cousin Etablissements Cousin Freres S.a.r.l., Flers, France

[21] Appl. No.: 513,413

[22] Filed: Jul. 14, 1983

[30] Foreign Application Priority Data

Jul. 19, 1982 [FR] France ..... 82 12545
Jul. 8, 1983 [FR] France ..... 83 11436

[51] Int. Cl.[3] ..... E05C 13/10

[52] U.S. Cl. ..... 292/201; 292/216; 292/DIG. 14; 292/45

[58] Field of Search ..... 292/201, 144, 216, 336.3, 292/DIG. 14, 45

[56] References Cited

U.S. PATENT DOCUMENTS 3,905,627 9/1975 Fujita ..... 292/216
4,270,783 6/1981 Sorensen et al. ..... 292/201 X

FOREIGN PATENT DOCUMENTS 912983 1/1958 United Kingdom ..... 292/201

*Primary Examiner*—Richard E. Moore
*Attorney, Agent, or Firm*—Browdy and Neimark

[57] ABSTRACT

Electric safety lock, more specially designed for motor vehicle doors, in which each vehicle door as well as the motor bonnet, the petrol tank cap and the luggage boot of the vehicle are each equipped with a set consisting of a case in which an electric micro-motor is mounted.

9 Claims, 13 Drawing Figures

ELECTRIC SAFETY LOCK MORE SPECIALLY FOR MOTOR VEHICLE DOORS

FIELD OF THE INVENTION

The present invention relates to an electric safety lock more specially for motor vehicle doors or the like, which has been studied to obtain a very light-weight device, which can be easily placed in modern motor vehicles, and which exactly meets the modern safety rules and regulations, and can be operated by remote control so that all doors as also the motor bonnet and the petrol tank cap as well as the luggage boot may be simultaneously unlocked by a same operation.

BACKGROUND OF THE INVENTION

Moreover it will be noted that many conventional locks for motor vehicle doors comprise a door blocking and unblocking device which is electrically or manually operated but in such a way that it is always necessary to operate the manual controls in order to unbolt the lock and allow it to be disengaged.

OBJECTS AND SUMMARY OF THE INVENTION

In the present case, the electric safety lock is used for unbolting a door, specially a door of a motor vehicle in order to allow it to be open. In the present lock, all usual operating-levers have been eliminated and merely replaced by an electronic device which works only when programmed for unbolting.

To ensure that the lock can be mounted from the outside in the door field thus resulting in a very important labour-saving, and that the lock can be unbolted in case of failure of the electronic circuit, the present invention provides a number of complementary features.

The present electric safety lock allows the rear doors to be blocked when children are to be transported and also meets the regulations in force for protection from rape in the U.S.A. so as to shield the occupant or occupants of the car when stationary.

The present invention provides an electric lock the main feature of which consists in means for electrically unbolting the lock, so that a door can be opened by rotation as a result of a simple motion, since it is the pressure of the joints surrounding the door that pushes the latter so that it opens.

According to the invention, the shaft of a motor mounted in a case drives a pinion which cooperates with a reducer that permanently engages with a toothed cam having a protruding part which cooperates with a push-finger which passes through the above mentioned case in the inner wall of a casing so as to control the rotation of a ratchet the end tooth of which engages into the teeth of a rotating bold fitted in the case and comprising an hollow-cut part receiving the bar which forms the lock-staple and the motor feeding is controlled by a printed circuit which may open the door or temporarily close it with the help of switches and circuit-breakers for shielding the occupants of the vehicle.

BRIEF DESCRIPTION OF THE DRAWINGS

An embodiment of the invention is described hereafter as a no restrictive example with reference to the annexed drawings.

DETAILED DESCRIPTION OF THE INVENTION

Figure 2:
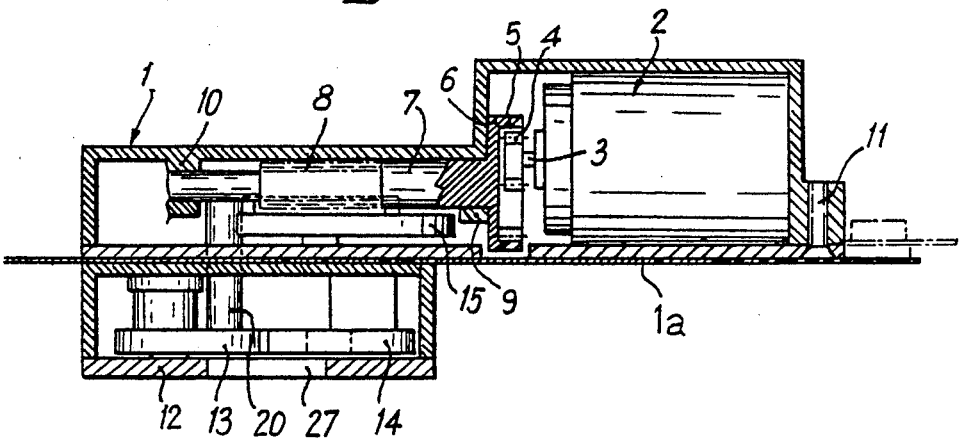
FIG. 2 is a cross-section along line II—II in FIG. 1 showing the casing and the case of the lock as well as the parts contained therein.
Figure 1:
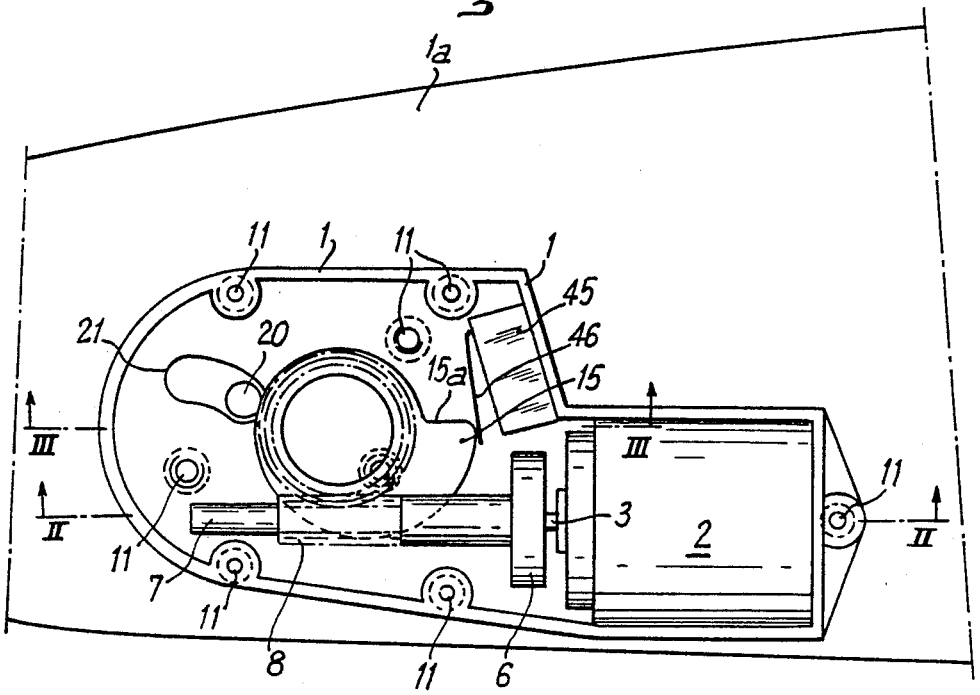
FIG. 1 is a side elevation view of the casing comprising different parts controlling the bolt of a lock.
Figure 3:
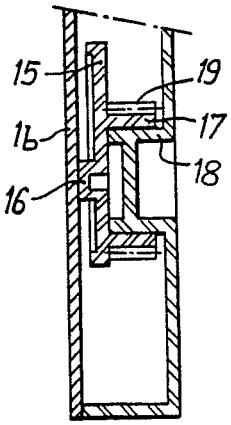
FIG. 3 is a cross-section along line III—III in FIG. 1 partially showing the lock mechanism.

In FIGS. 1 and 2, reference numeral 1 indicates a plate 1*a* on one side of which is fixed a casing 1 which contains in its right part an electric micro-motor 2 the shaft 3 of which carries a pinion 4 which engages into the teeth 5 of a disc-shaped part 6 rigidly fixed to a shaft 7 the central part of which is equiped with an endless screw 8. The shaft 7 is supported by bearings 9, 10 in the case 1. The case 1 is fixed by screws 11 on the plate 1*a*. A casing 12 having an essentially rectangular shape is fixed on the other side of the plate 1*a* and comprises on the one side a ratchet 13 and on the other side a bolt 14 described hereafter. The endless screw 8 in the case 1 engages into a cam 15 which is also mounted in the case 1 and comprises a shoulder 16 (FIG. 3), which is supported by the inner side 1*b* of the case 1, and a circular extension 17 centered on a boss 18 protruding from the front side of the case 1. The circular extension 17 comprises on its outer side a number of teeth 19 which permanently engage into the endless screw 8 of the shaft 7.

The cam 15 comprises a step 15*a* cooperating with a pushing finger 20 which passes through an arcuate opening 21 which has been made in the case 1 and in the inner wall of the casing 12 and is connected with the ratchet 13. Thus, the ratchet 13 may be rotated by the pushing finger 20 about the pin 13*a* on which it is rigidly fastened and which is mounted in the walls of the case 12. The sharp-pointed fore-end 13*b* of the ratchet 13 is intended for cooperating with the teeth 14*a* of the bolt 14 which is also mounted so as to rotate about a pin 23 rigidly mounted on the walls of the case 12.

Figure 5:
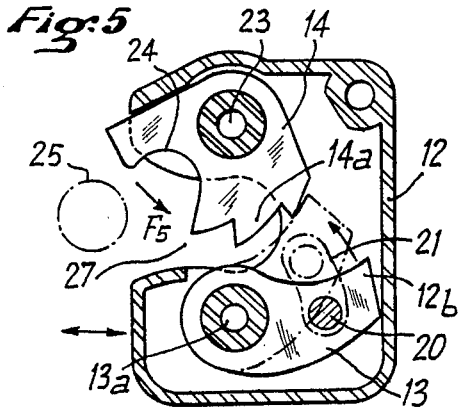
FIG. 5 is a view corresponding to FIG. 4 but showing the door when open.
Figure 4:
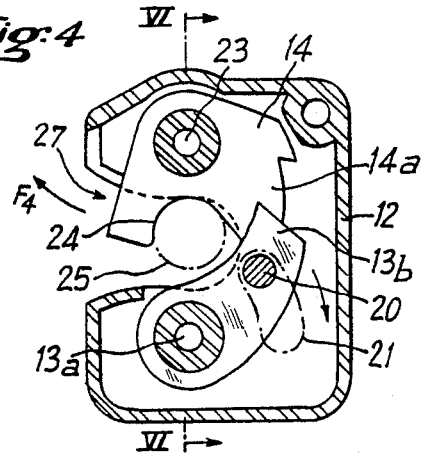
FIG. 4 is a cross section-elevation of the case showing the bolt and its controls when the lock is closed.
Figure 6:
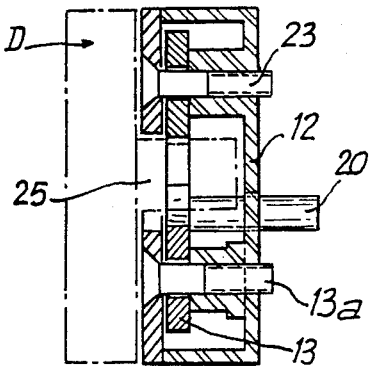
FIG. 6 is a cross-section along line VI—VI in FIG. 4.

As particularly shown in FIGS. 4 and 5 the bolt 14 comprises a cut off part 24 having an essentially circular shape and receiving a bar 25 which forms the staple of the lock and which is fastened to the door post or frame of the vehicle.

As also shown in FIGS. 4 and 5 the central upper part of the case 12 coimprises an opening 27 provided to receive the bar 25.

Figure 7:
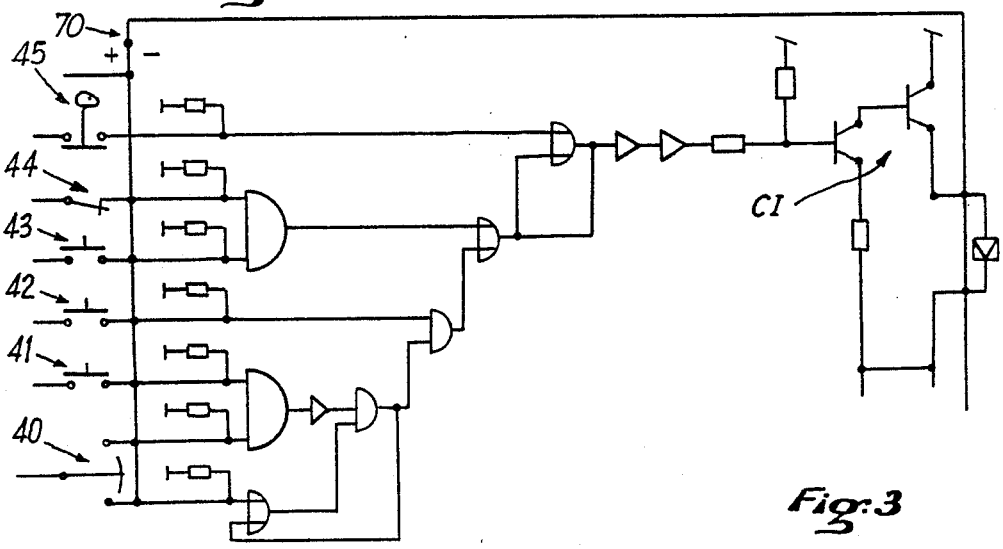
FIG. 7 is an electric diagram illustrating the working way of motor-vehicle locks enabling to bolt the doors and the different opening parts of a motor vehicle.

As shown in FIG. 7, a printed circuit C1 provides a supply of the motor 2 with electric current under the control of following switches: 40 for unbolting, 41 for bolting, 42 for unblocking the doors when one of them bangs, 43 for controlling the door through an inner button, 44 for blocking each door for children's safety, and 45 for limiting the movement of the cam 15. The control device for the limit switch 45 is shown in FIG. 1 with its deformable finger 46. The source of electric power is the electric power battery 70 of the vehicle. Because of the design of the printed circuit which distributes the functions, the various controls may be mounted in any place in the vehicle.

The preceding description makes clear the working of the locking device.

When the lock is open, the staple 25 (FIG. 5) is entirely disengaged from the hollow part 24 of the bolt 14, and the ratchet 13 is disengaged from the teeth 14*a* of the bolt 14.

When the door is closed, the staple 25 engages into the casing 12 through the opening 27 and into the cut part 24 of the bolt 14 which turns in the direction of the arrow F5 (FIG. 5) in the position represented by FIG. 4, i.e. in which the door is closed, bolted and blocked since the sharp-pointed end 13*b* of the ratchet 13 is engaged in one of the teeth 14*a* of the ratchet 14 under action of a spring, not represented.

In order to open the door, the motor 2 is supplied with electric power, which causes rotation of the endless screw 8, a rotation of the cam 15 and consequently a rotation of the pushing finger 20 which unbolts and disengages the ratchet 13 from the teeth 14*a* of the bolt 14 which becomes free and can easily pivot in direction of the arrow F4 (FIG. 4). Thus the door can be opened since the staple 25 is disengaged.

Of course, this lock is controlled either through the above mentioned switches represented in FIG. 7 or, as known, through the motor vehicle key which operates the switches 43, 44.

It will be noted that due to its electric construction, this lock is appreciably lighter than other locks which are controlled either through an electromechanical element or through a pneumatic jack.

In order to get a sufficient security in the case of an interruption of power supply, it is possible to provide a supplementary current plug accessible from the exterior of the vehicle which may be mounted on the vehicle and allow the door to be open by application of an electric current which would not be produced by the vehicle. However opening the vehicle in this case is possible only with the specific key of the vehicle.

Figure 9:
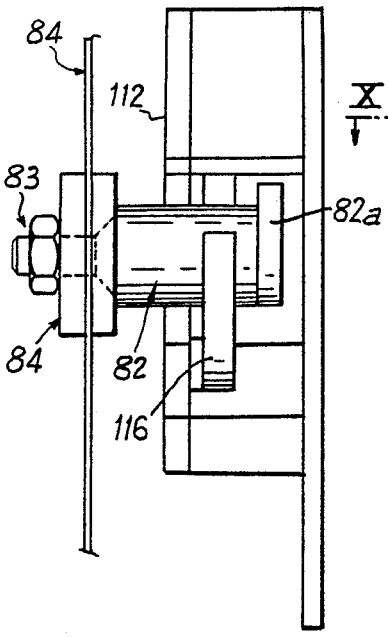
FIG. 9 is a side elevation view substantially taken according to arrow F2 in FIG. 8.
Figure 12:
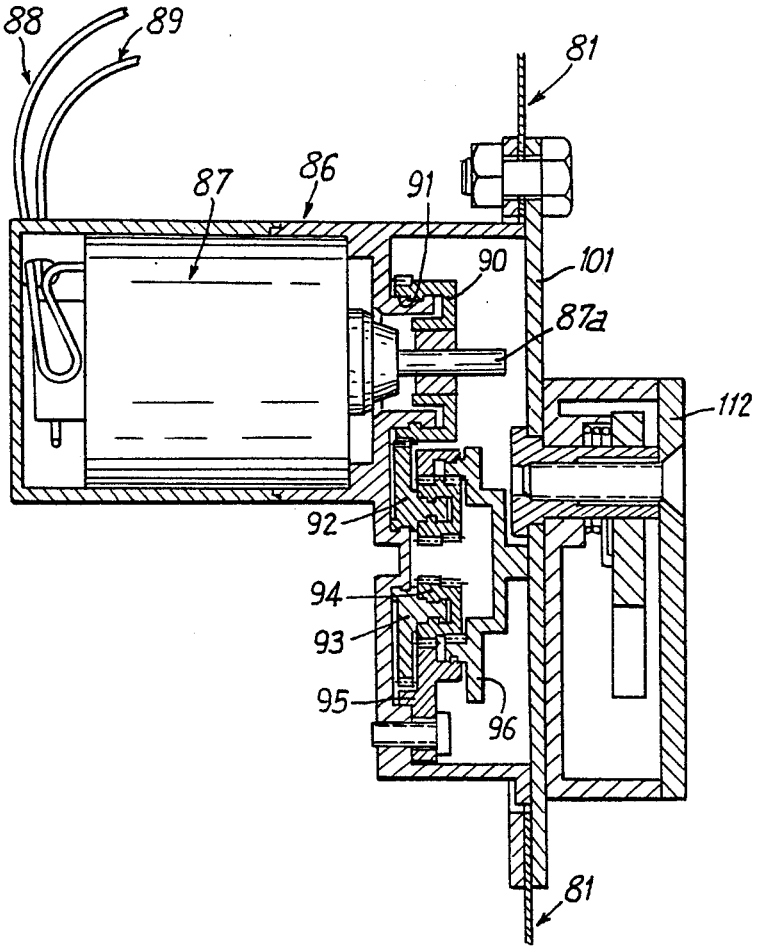
FIG. 12 is a cross section along line XII—XII in FIG. 11.

In the embodiment represented in FIGS. 8–13, the lock shown at 80 is mounted in the thickness of a vehicle door schematically represented in FIG. 12 by the sheet 81 while the staple 82 formed by cylindrical bar is fixed through an extension 83 on the sheet 84 of the door post, i.e. on the vehicle body (See FIG. 9). Reference number 85 indicates the counterplate of the staple 82 which is terminated by an asymetrical head 82*a*.

The lock 80 comprises a case 86 containing an electric motor 87 supplied through cables 88–89. A pinion 90 is fixed to the shaft 87*a* of the motor 87 which pinion 90 is guided during its rotation by a bore 91 drilled in the fore-part of the casing 86. The pinion 90 cooperates with a reducer 92 comprising of a first pinion 93 which engages with a double toothed ring 94 held by a fixed ring 95 and with a pinion 96, resulting in a rotation speed of the pinion 96 which is reduced with respect to that of the motor 87.

Figure 11:
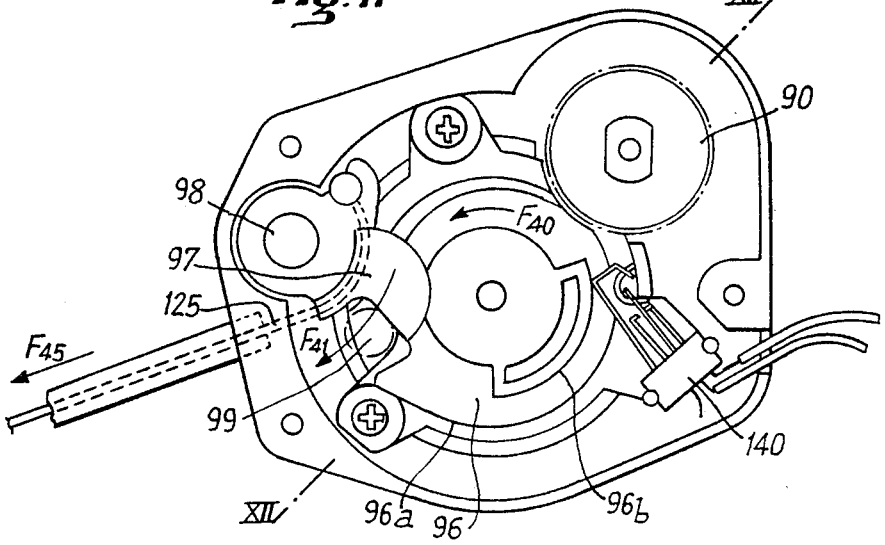
FIG. 11 shows the rear side of the lock.

As shown in FIG. 11, the pinion 96 has on its front side the shape of a cam 96*a* which, when turning in direction of the arrow F40 causes a rotation, in direction of the arrow F41, of a hook 97 mounted on a pin 98 in the casing 86. Movement of the hook 97 drives a finger 99 which can move in an arcuate opening 100 (FIG. 8) of the plate 101 which closes the case 86. The pushing finger 99 is rigidly fixed to the ratchet 113 inside the housing 112 situated on the other side of the plate 101.

Figure 8:
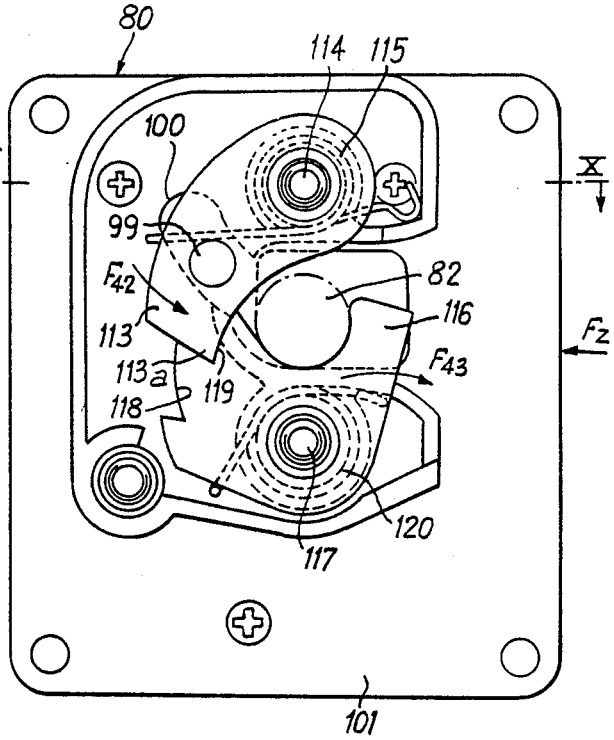
FIG. 8 is a front view of the lock without covering plate.

As better shown in FIG. 8, reference number 113*a* designates the end tooth of the ratched 113 which is supported by a pin 114 about which is mounted a compression spring 115 which tends to push away through its free ends the pushing finger 99 in the direction of the arrow F42.

The ratchet 113 cooperates with a bolt 116 which is substantially V-shaped and freely mounted on a pin 117. The bolt 116 comprises two teeth 118, 119 each intended for cooperating with the end tooth 113*a* of the ratchet 113.

A compression spring 120 tends permanently to cause a rotation of the bolt 116 in direction of the arrow F43.

Figure 10:
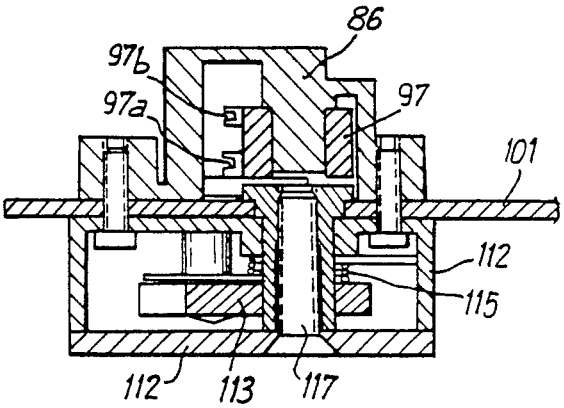
FIG. 10 is a cross-section along line X—X in FIG. 8.

In addition, as shown in FIGS. 10 and 11, the hook 97 comprises on a part of its periphery two guides 97*a*, 97*b* which support flexible cables 125 which enable, in case of failure of electric power, to draw the cables 125 in the direction of arrow F45 (FIG. 11) to unbolt the ratchet 113 from the bolt 116 in order to free it.

The locking device described above works as follows.

When a door equiped with this locking device is open, the various elements are at rest in the position indicated by FIGS. 8 and 12.

However, the bolt 116 is entirely pivoted to direction of the arrow F43 (FIG. 8) so that it is easy by bringing the door nearer to the frame 84, to engage the staple 82 into the bolt 116, thus causing the rotation of this bolt 116 in the direction inverse of that of the arrow F43. The ratchet 113 engages first into the tooth 118 and then into the tooth 119 of the bolt 116. As a result, the door is bolted since the staple 82 is held inside the bolt 116 which in its turn is blocked by the pushing finger 99 and the spring 115 (movement of the ratchet 113 in the direction of the arrow F42). The tooth 113*a* of the ratchet 113 is made in such a way that a rotation reaction of the ratchet 113 does not take place when a force is exerted on the teeth 119 and 118, what results in selfblocking. The spring 115 holds the tooth 113*a* of the ratchet 113 in the teeth 118, 119 when no pressure (rotation force) is exerted on the bolt 116.

The preceding explanations may apply to locks of all other doors bonnets, boots or caps of a given vehicle.

The power supplying circuits of the various motors 87 are each closed by a contact-breaker 140 (FIG. 11) controlled by a second cam 96*b* of the pinion 96.

When it is desired to open the bonnet or the doors of the vehicle either from the inside or from the outside, it is possible, by using fingers, the voice, a magnetic card or a specific key of the vehicle, to order the electronic circuit to interrupt supply of the various corresponding motors with electric power. For instance, the electronic circuit may comprise a microprocessor.

Each motor 87 drives, through a pinion 90, the reducer 92 which causes a one-revolution rotation of the cam 96 so that the pushing finger 99 is raised in the direction opposite to the arrow F42 (FIG. 8) thus causing unbolding of the ratchet 113. Each bolt 116 being free, each compression spring 120 will cause a rotation of the bolt 116 in direction of the arrow F43, which disengage each staple 82. Under the pressure exerted by the tight joints, the doors, bonnets, boots and caps can now rotate in the direction of opening.

As explained above, it is possible by using controls operated by hand and consisting of cables 125, to unblock the locks in case of a failure in the electric power supply, but it is possible also to incorporate, in the power circuit of the motors 87, a dry cell or battery which can perform an unblocking action by unbolting the ratchets 113.

As indicated above, the locks according to the invention are intended for unblocking, i.e. for unbolting, in order to enable a door or a bonnet or the like to be opened by using the pressure exerted by the tight joints so as to separate the lock elements from the corresponding staple.

Of course, in the same way as indicate above the electronically controlled electric circuit enables (1) an outer and an inner control, (2) a security for children by preventing an untimely unbolding of doors and (3) to block the doors and bonnets and the like according to the "anti-rape" rules and regulations in force in some foreign countries and particularly in the United States.

Figure 13:
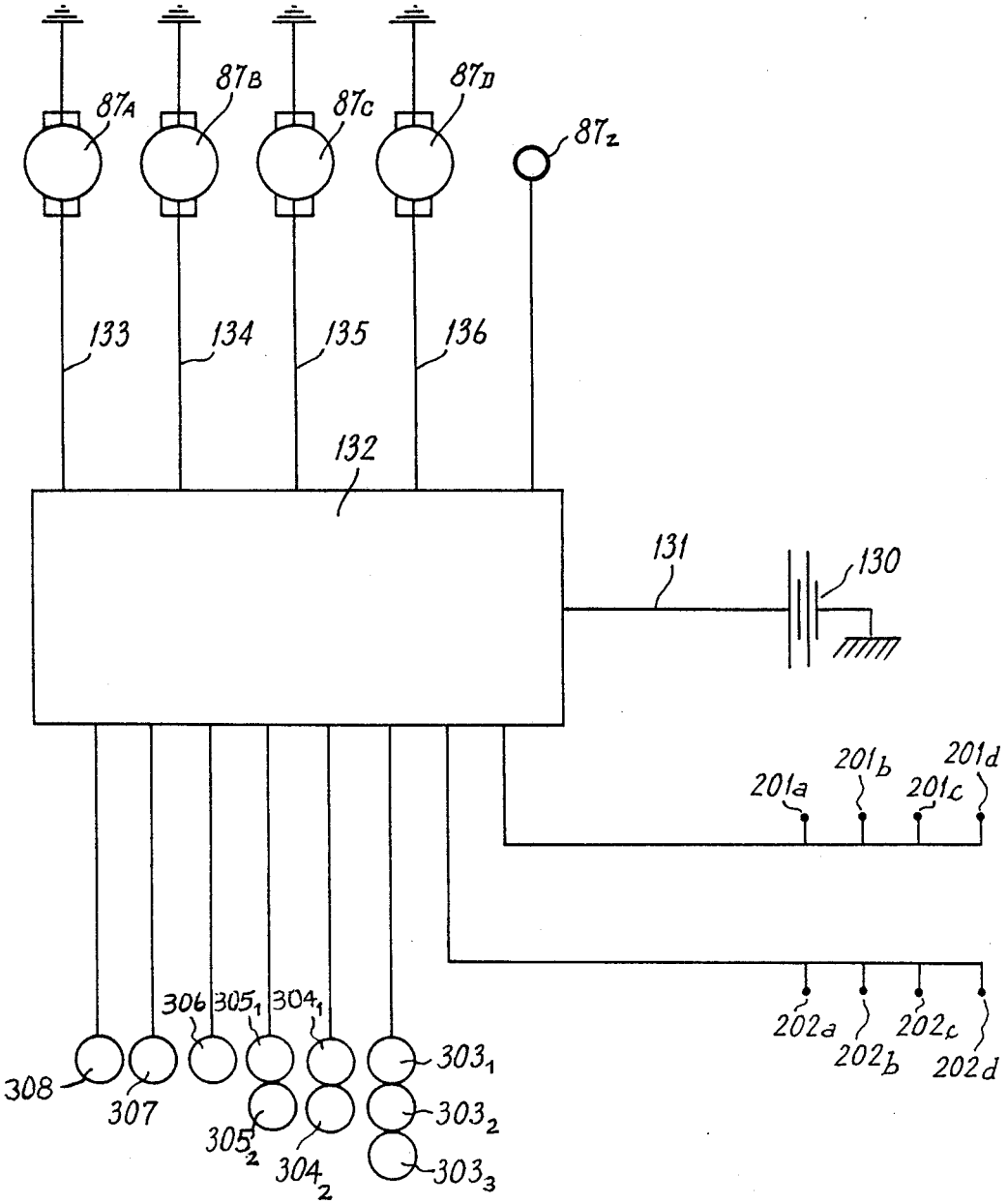
FIG. 13 is a simplified diagram showing the electronic controls of a vehicle lock.

As a non restrictive example, FIG. 13 represents an electric diagram for a motor car comprising four motors 87A, 87B, 87C, 87D which are each supply from a battery 130 through a conductor 131 leading to a printed circuit or microprocessor 132 and then to circuits controlling the various motors and diagrammatically shown at 133, 134, 135, 136.

The circuits 133, 134, 135, 136 are monitored through the printed circuit or microprocessor 132 by means of control buttons 201*a*, 201*b*, 201*c*, 201*d* (control buttons outside the vehicle) and 202*a*, 202*b*, 202*c*, 202*d* (control buttons inside the vehicle). Moreover the various fonctions provided by the printed circuit or microprocessor 132 are controlled by function buttons $303_1$, $303_2$, $303_3$, $304_1$, $304_2$, $305_1$, $305_2$, 306, 307, 308.

This been said, the device may work as follows:

Outer buttons 201*a*, 201*b*, 201*c*, 201*d*

It is possible to supply the motors 87A, 87B, 87C, 87D in order to unbolt the doors from the inside.

Inner buttons 202*a*, 202*b*, 202*c*, 202*d*

It is possible to supply the motors 87A, 87B, 87C, 87D in order to unbolt the doors from outside.

Function 303 ($303_1$, $303_2$, $303_3$)

It is possible to block the rear doors (security for children) and by using the functions $303_2$ and $303_3$ to temporarily block the rear door on the right or on the left without leaving the vehicle.

Function 304 ($304_1$, $304_2$)

In order to open the doors, various means may be used: conventional key operating a switch, electronic means (electronic key, magnetic card, code numbers on a finger key-board . . . )

Function 306

When one door is open it is impossible to block the doors.

Function $305_1$, $305_2$

It is possible to block the four doors of the vehicle from the inside.

Function 308

It is impossible to open the doors from the inside of the vehicle if they have not been previously unblocked from outside (protection from theft).

Function 307

It is possible to entirely or partially unblock the doors by using an inertia system for instance in the case of an accident. It is also possible to provide other functions in the printed circuit or microprocessor.

87z designates a check lamp or lem.

What is claimed is:

1. Electric safety locks, more specially designed for motor vehicle doors, in which each of the vehicle doors including the motor bonnet, the petrol tank cap and the luggage boot of the vehicle are equipped with a set consisting of a case (1) in which an electric micro-motor (2) is mounted, and wherein a shaft (3) of the motor drives a pinion (4) cooperating with a reducer which permanently engages with a toothed cam (15) having a protruding part (15*a*) which cooperates with a pushing finger (20) which passes through the case (1) and an anterior wall of a casing (12) so as to control rotation of a ratchet (13) having an end tooth (13*b*) which engages into teeth of a rotating bolt which is mounted in the casing (12) and comprises a cut opening (24) which receives a bar (25) which forms a lock-staple (25) and that supplying of the motor is monitored by a printed circuit which enables, by using switches (40, 41, 42, 43, 44) the door to be open or temporarily closed for protection of occupants of the vehicle.

2. Electric safety lock according to claim 1, wherein the cam (15) cooperates with a deformable finger (46) of a limit micro-switch for stopping or beginning a supply operation of the micro-motor (2).

3. Electric safety lock according to claim 1, wherein the case (12) comprises in its inner side an opening (27) for introducing the bar (25) functioning a staple.

4. Electric safety lock according to claim 1, wherein the opening (21) receiving the pushing finger (20) is curved.

5. Electric lock more specially for vehicle doors according to claim 1, wherein the motor (87) drives through said pinion (90) the reducer (92) causing rotation of a second pinion (96) during a complete rotation so that the toothed cam (96*a*) operatively connected to said second pinion causes the pushing finger (99) to move which controls the rotation of the ratchet (113), a tooth (113*a*) of which, when disengaging the teeth (118, 119) of the rotating bolt, disengages by intermediary of a resilient element (120) the lock staple (82) rigidly fastened to a frame of the corresponding door.

6. Electric lock according to claim 5, wherein the ratchet (113) is permanently submitted to action of a compression spring (115) which holds the tooth (113*a*) of the ratchet (113) in the teeth (118, 119) of the rotating bolt (116) while the door is closed.

7. Electric lock according to claim 5, wherein the bolt (116) is submitted to action of a compression spring (120) which is coaxially mounted on a pin (117) of the rotating bolt (116) and tends to cause said rotating bolt (116) to turn in direction of opening.

8. Electric lock according to claim 5, wherein an idle hook (97) mounted on a pin (98) of the casing is controlled by hand through a cable (125) so that the pushing finger (99) is allowed to turn whereby the ratchet (113) raises and the bolt (116) is unblocked in order to open the corresponding door.

9. Electric lock according to claim 1, wherein the reducer comprises a disc shaped part (6) fixed at the end of a shaft (7) supported by bearings (9, 10) and comprising in its center an endless screw (8).

* * * * *